US009849350B2

(12) United States Patent
Dacey et al.

(10) Patent No.: US 9,849,350 B2
(45) **Date of Patent: *Dec. 26, 2017**

(54) ADJUSTABLE GOLF CLUB SHAFT AND HOSEL ASSEMBLY

(71) Applicant: Callaway Golf Company, Carlsbad, CA (US)

(72) Inventors: Kevin P. Dacey, La Jolla, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/402,548

(22) Filed: Jan. 10, 2017

(65) Prior Publication Data

US 2017/0113102 A1 Apr. 27, 2017

Related U.S. Application Data

(60) Continuation of application No. 14/872,335, filed on Oct. 1, 2015, now Pat. No. 9,539,474, which is a division of application No. 14/452,157, filed on Aug. 5, 2014, now Pat. No. 9,174,097, which is a continuation-in-part of application No. 13/332,846, filed on Dec. 21, 2011, now abandoned, which is a continuation-in-part of application No. 13/326,156, filed on Dec. 14, 2011, now Pat. No. 8,715,102, which is a continuation-in-part of application No. 13/311,319, filed on Dec. 5, 2011, now Pat. No. 8,684,859.

(Continued)

(51) Int. Cl.
*A63B 53/02* (2015.01)
*A63B 53/06* (2015.01)
*A63B 53/04* (2015.01)

(52) U.S. Cl.
CPC ..... *A63B 53/02* (2013.01); *A63B 53/047* (2013.01); *A63B 53/0466* (2013.01); *A63B 53/0487* (2013.01); *A63B 53/06* (2013.01); *A63B 2053/022* (2013.01); *A63B 2053/023* (2013.01)

(58) Field of Classification Search
CPC ... A63B 53/02; A63B 53/0466; A63B 53/047; A63B 53/0487; A63B 2053/022; A63B 2053/023; A63B 2053/025; A63B 2053/026; A63B 2053/027; A63B 53/06
See application file for complete search history.

(56) References Cited

U.S. PATENT DOCUMENTS 5,199,152 A * 4/1993 Wagner ..... F16B 41/002 29/444
5,244,325 A * 9/1993 Knohl ..... F02B 77/00 411/107

(Continued)

*Primary Examiner* — Stephen Blau
(74) *Attorney, Agent, or Firm* — Rebecca Hanovice; Michael Catania; Sonia Lari

(57) ABSTRACT

An adjustable shaft and hosel assembly allows for dependent and independent adjustment of a golf club's face angle, loft angle, and lie angle. The adjustable shaft and hosel assembly comprises a shaft sleeve, a hosel portion, a tubular adjustment piece having non-parallel upper and lower surfaces, and a retention feature that provides an engagement between the tubular adjustment piece and the shaft sleeve to prevent the tubular adjustment piece from becoming detached from the shaft sleeve.

13 Claims, 6 Drawing Sheets

Related U.S. Application Data

(60) Provisional application No. 61/949,169, filed on Mar. 6, 2014, provisional application No. 61/451,523, filed on Mar. 10, 2011, provisional application No. 61/452,521, filed on Mar. 14, 2011.

(56) References Cited

U.S. PATENT DOCUMENTS

| | | | | | |
|---|---|---|---|---|---|
| 5,662,444 | A * | 9/1997 | Schmidt, Jr. | F16B 41/002 | 411/353 |
| 6,280,132 | B1 * | 8/2001 | Szczukowski | F02F 7/006 | 411/107 |
| 7,083,529 | B2 * | 8/2006 | Cackett | A63B 53/02 | 473/309 |
| 7,997,997 | B2 * | 8/2011 | Bennett | A63B 53/02 | 473/288 |
| 8,235,839 | B2 * | 8/2012 | Bennett | A63B 53/02 | 473/246 |
| 8,303,431 | B2 * | 11/2012 | Beach | A63B 53/02 | 473/307 |
| 8,480,511 | B2 * | 7/2013 | Sargent | A63B 53/0466 | 427/331 |
| 8,961,329 | B2 * | 2/2015 | Sander | A63B 53/02 | 473/246 |
| 9,737,775 | B2 * | 8/2017 | Brunski | A63B 60/42 | |

* cited by examiner

ADJUSTABLE GOLF CLUB SHAFT AND HOSEL ASSEMBLY

CROSS REFERENCES TO RELATED APPLICATIONS

The present application is a continuation of U.S. patent application Ser. No. 14/872,335, filed on Oct. 1, 2015, and issued on Jan. 10, 2017, as U.S. Pat. No. 9,539,474, which is a division of U.S. patent application Ser. No. 14/452,157, filed on Aug. 5, 2014, and issued on Nov. 3, 2015, as U.S. Pat. No. 9,174,097, which claims priority to 61/949,169, filed on Mar. 6, 2014, and is a continuation-in-part of U.S. patent application Ser. No. 13/332,846, filed on Dec. 21, 2011, which is a continuation-in-part of U.S. patent application Ser. No. 13/326,156, filed on Dec. 14, 2011, and issued on May 6, 2014, as U.S. patent No. 8,715,102, which is a continuation-in-part of U.S. patent application Ser. No. 13/311,319, filed on Dec. 5, 2011, and issued on Apr. 1, 2014, as U.S. Pat. No. 8,684,859, which claims priority to U.S. Provisional Application No. 61/451,523, filed on Mar. 10, 2011, and to U.S. Provisional Application No. 61/452,521, filed on Mar. 14, 2011, to each of which the present application also claims priority, and the disclosures of each of which are hereby incorporated by reference in their entireties herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having an adjustable shaft and hosel assembly. More specifically, the present invention relates to a golf club shaft and hosel connection assembly comprising one or more shims that permit a user to adjust the loft, lie, and face angle of the golf club head, either dependently or independently without requiring the user to remove the shaft from the hosel completely.

Description of the Related Art

It is known that changing the angle of a golf club shaft with respect to the golf club head will change certain club specifications, including loft angle, lie angle, and face angle.

Several types of adjustable golf clubs are currently available on the market. These models allow the user to adjust one or more of the golf club head's loft, lie and face angle by adjusting certain golf club components, which themselves rotate the shaft in a cone-shaped path about a reference axis.

Several of these models include angled wedges or tubular adjustment features that are retained on a shaft sleeve with features such as those disclosed in U.S. Pat. No. 8,235,839. The problem with these retention features, and in particular the separate retainer disclosed in connection with FIG. 38 of that reference, is that the retainer is often composed of a weaker material than the shaft sleeve and thus has a high failure rate. Furthermore, once the retainer is affixed to the shaft sleeve as disclosed in U.S. Pat. No. 8,235,839, the retainer must be permitted to move in a circular pattern during adjustment of the tubular adjustment feature (which moves the shaft sleeve around a cone-shaped path), and thus the shaft sleeve of golf club head, between its available angular positions. This movement requires that the hosel bore be sized to permit the movement of the retainer. The movement of the retainer thus becomes the limiting factor when calculating the minimum hosel bore for a golf club head, and can lead to a hosel having an undesirably large diameter, thereby limiting where the hosel can be disposed on a golf club head. Therefore, there is a need for adjustable golf clubs having narrower hosel bores and stronger, more streamlined adjustability retention features.

BRIEF SUMMARY OF THE INVENTION

The present invention relates to golf club heads that include tubular shims, which permit a golfer to adjust the loft, lie, and face angle of the golf club head, either dependently or independently of one another, and retention features that retain the shims on a shaft sleeve so that removing a shaft sleeve from a golf club head does not cause the shims to disengage from the shaft sleeve. In particular, the present invention dispenses with the use of a separate retention piece to save on cost, reduce the inside diameter of a golf club hosel, increase the ease of manufacturing, and reduce the failure rate.

One aspect of the present invention is an adjustable golf club comprising a golf club head comprising a hosel, a shaft, a shaft sleeve comprising a tip end, a middle portion, an upper end, a shaft-receiving bore disposed in the upper end and extending into the middle portion, an external surface, and a first ridge protruding from the external surface, and a first tubular adjustment piece comprising non-parallel upper and lower surfaces, an interior surface, and a second ridge protruding from the interior surface, the tubular adjustment piece encircling at least a part of the middle portion of the shaft sleeve, wherein the first ridge abuts the second ridge to removably fix the tubular adjustment piece on the shaft sleeve between the second ridge and the upper end. In some embodiments, the first ridge may be integrally formed with the shaft sleeve, the second ridge may be integrally formed with the first tubular adjustment piece. In a further embodiment, the golf club head may comprise a fastener comprising a head and a threaded extension, the tip end of the shaft sleeve may comprise a threaded tip bore, and the threaded extension may engage with the threaded tip bore. In a further embodiment, the tip end may be bell shaped.

In some embodiments, each of the shaft sleeve and the first tubular adjustment piece may be composed of an aluminum alloy. In another embodiment, the first ridge may extend around the entire circumference of the shaft sleeve, and the second ridge may not extend around the entire internal circumference of the first tubular adjustment piece. In one embodiment, the golf club may further comprise a second tubular adjustment piece, which may encircle at least a part of the middle portion of the shaft sleeve and which may be disposed between the first tubular adjustment piece and the upper end of the shaft sleeve. In a further embodiment, the second tubular adjustment piece may comprise a third ridge protruding from an interior surface. In some embodiments, the upper end of the shaft sleeve may have a first diameter, the middle portion of the shaft sleeve may have a second diameter, the tip end of the shaft sleeve may have a third diameter, and the first diameter may be greater than both the second diameter and the third diameter. In a further embodiment, the first tubular adjustment piece may be movable between the first ridge and the upper end when the shaft sleeve is not engaged with the hosel. In another embodiment, the first tubular adjustment piece may comprise a plurality of teeth, and the second ridge may be disposed on at least one of the plurality of teeth.

Another aspect of the present invention is an adjustable golf club comprising a golf club head comprising a hosel, a shaft, a shaft sleeve comprising a tip end, a middle portion, an upper end, a shaft-receiving bore disposed in the upper end and extending into the middle portion, an external surface, and a ridge protruding from the external surface, and a first tubular adjustment piece having non-parallel upper and lower surfaces and at least one alignment bore extending through at least one side wall, the tubular adjustment piece encircling at least a portion of the shaft sleeve, and at least one alignment pin disposed within the at least one alignment bore and protruding away from an interior surface of the first tubular adjustment piece, wherein the at least one alignment pin abuts the ridge to removably fix the first tubular adjustment piece on the shaft sleeve between the ridge and the upper end. In some embodiments, the at least one alignment bore may comprise first and second alignment bores, and the at least one alignment pin may comprise first and second alignment pins.

In another embodiment, each of the shaft sleeve and the first tubular adjustment piece may be composed of an aluminum alloy, and the at least one alignment pin may be composed of a polymeric material. In another embodiment, the first tubular adjustment piece may comprise a plurality of teeth, and the at least one alignment bore may be disposed in at least one of the plurality of teeth. In yet another embodiment, the golf club may further comprise a fastener comprising a head and a threaded extension, the tip end of the shaft sleeve may comprise a threaded tip bore, and the threaded extension may engage with the threaded tip bore. In a further embodiment, the tip end may be bell shaped. In another embodiment, the first tubular adjustment piece may be movable between the first ridge and the upper end when the shaft sleeve is not engaged with the hosel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention can be used with any adjustable hosel configuration that includes tubular shim features, including those disclosed in U.S. Pat. No. 8,403,770, the disclosure of which is hereby incorporated by reference in its entirety herein, and in U.S. Pat. No. 8,235,839.

Figure 1:
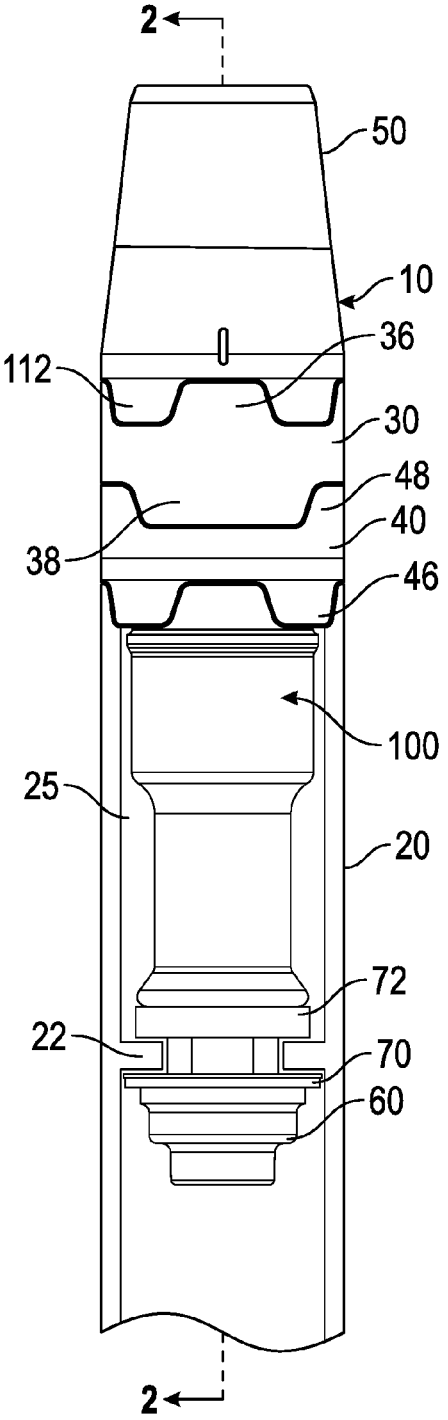
FIG. 1 is a side, perspective view of a first embodiment of a shaft sleeve comprising shims engaged with a partially transparent hosel.
Figure 2:
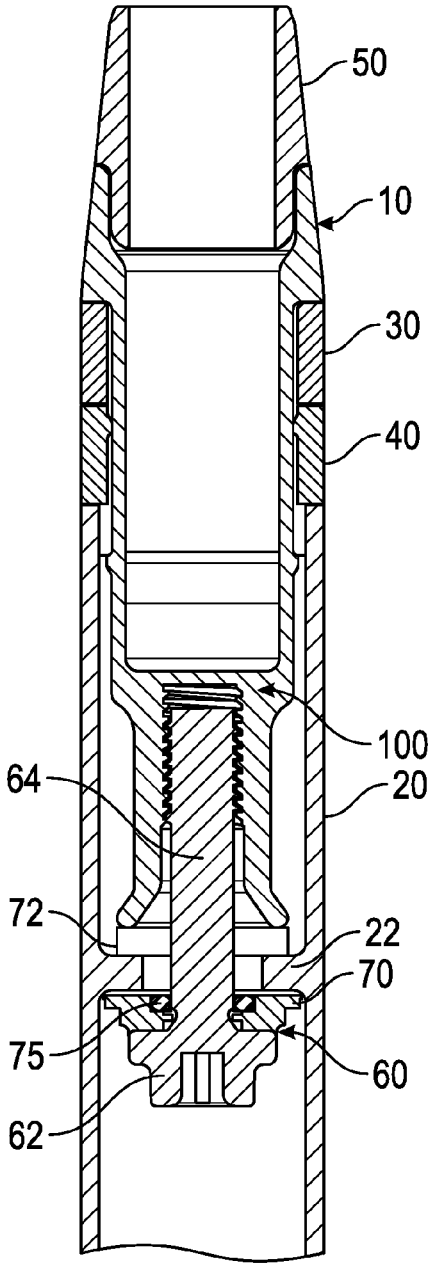
FIG. 2 is a cross-sectional view of the embodiment shown in FIG. 1 along lines 2-2.

A preferred embodiment of the present invention is shown in FIGS. 1-7. FIGS. 1 and 2 show the preferred adjustable hosel assembly 10 engaged with an exemplary hosel 20, which may be affixed to or integrally formed with any type of golf club head, including a driver, fairway wood, hybrid, iron, wedge, or putter. As shown in FIGS. 1 and 2, the adjustable hosel assembly 10 comprises a shaft sleeve 100, a pair of tubular adjustment pieces, also referred to herein as shims 30, 40, a ferrule 50, a fastener 60 comprising a head 62 and a threaded portion 64, a pair of washers 70, 72, and an o-ring 75. The hosel 20 shown in these Figures comprises a bore 25 sized to receive at least a part of the shaft sleeve 100, and includes a flange 22 against which the washers 70, 72 and o-ring 75 rest when the fastener 60 is fully engaged with the shaft sleeve 100. The bore 25 must be large enough to permit the shaft sleeve 100 to move when the shims 30, 40 adjust the angle of a shaft with respect to the hosel 20 and the golf club head to which it is attached, but not as large as it would have to be if a separate retainer cap were attached to the shaft sleeve 100.

Figure 3:
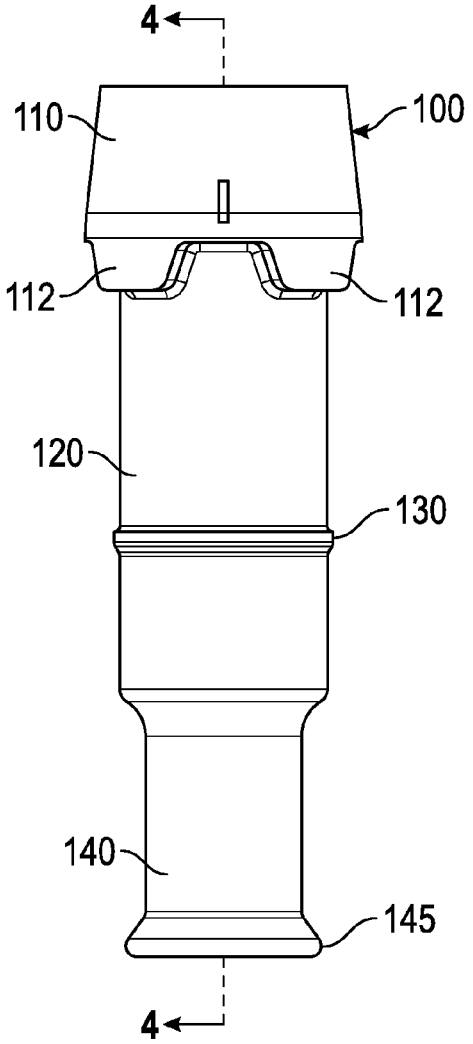
FIG. 3 is a side perspective view of the shaft sleeve shown in FIG. 1.
Figure 4:
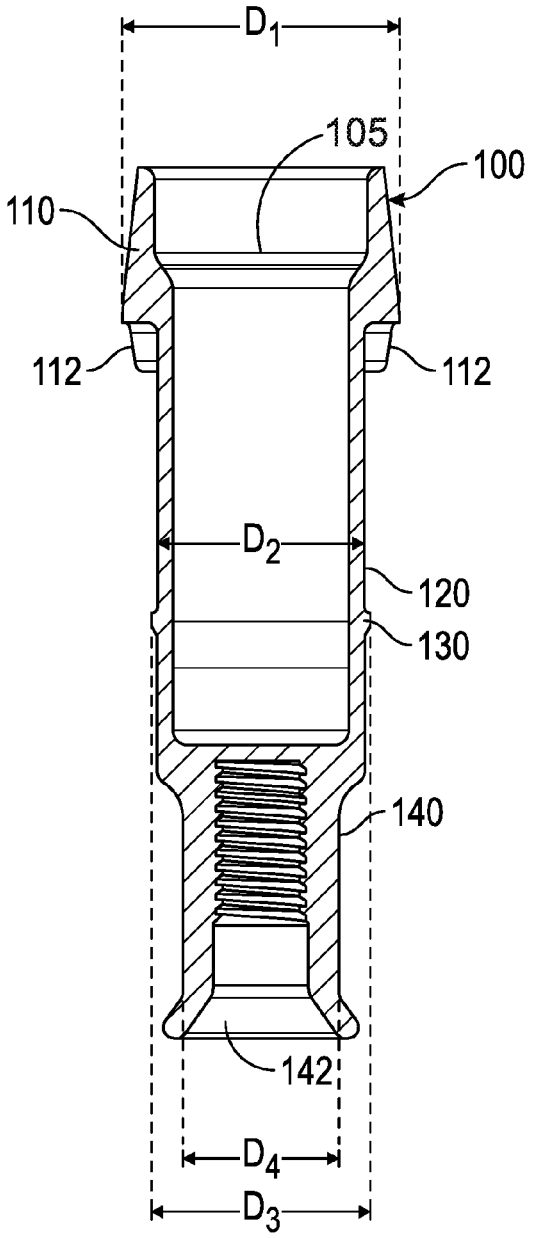
FIG. 4 is a cross-sectional view of the shaft sleeve shown in FIG. 3 along lines 4-4.

The shaft sleeve 100, shown alone in FIGS. 3 and 4, comprises an upper portion 110 having the greatest diameter $D_1$ and a set of teeth 112 that act as alignment features when interacting with one of the shims 30, 40, a middle portion 120 having a second diameter $D_2$ that is smaller than $D_1$, a ridge 130 disposed on the external surface, and extending completely around the circumference, of the middle portion 120, the ridge 130 having a third diameter $D_3$ that is greater than $D_2$ but smaller than $D_1$, and a tip portion 140 that has the smallest diameter $D_4$ and a bell-shaped flared region 145 at its terminus with a diameter $D_5$ that is smaller than or equal to $D_2$ and greater than $D_4$ ($D_4<D_5\leq D_2$). The shaft sleeve 100 also includes a sleeve bore 105, which preferably has a bore axis that is coaxial with an overall axis of the shaft sleeve 100; in other words, without more, rotating the shaft sleeve 100 of the present invention within the hosel 20 will not change the angle between the shaft and the hosel 20. The tip portion 140 includes a threaded joint bore 142 sized to receive the threaded portion 64 of the fastener 60, which allows a user to fix the shaft sleeve 100 to a hosel 20 as shown in FIGS. 1 and 2. The flared region 145 helps to catch the threaded portion 64 of the fastener 60 when a user attempts to secure the shaft sleeve 100 to the hosel 20 during assembly.

Figure 5:
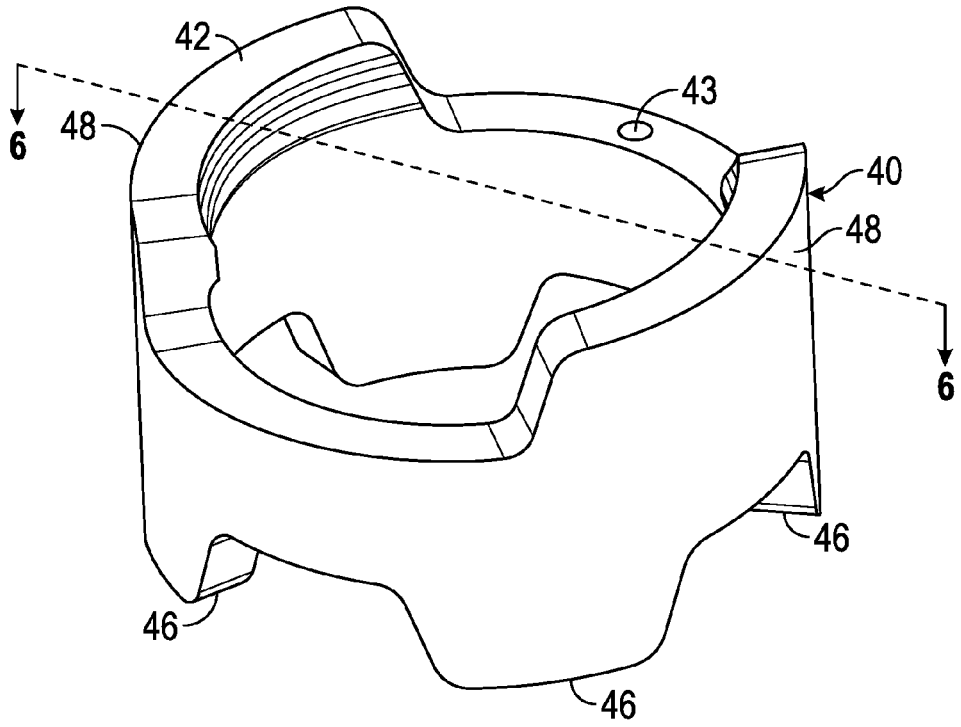
FIG. 5 is a top perspective view of the lower shim shown in FIG. 1.
Figure 6:
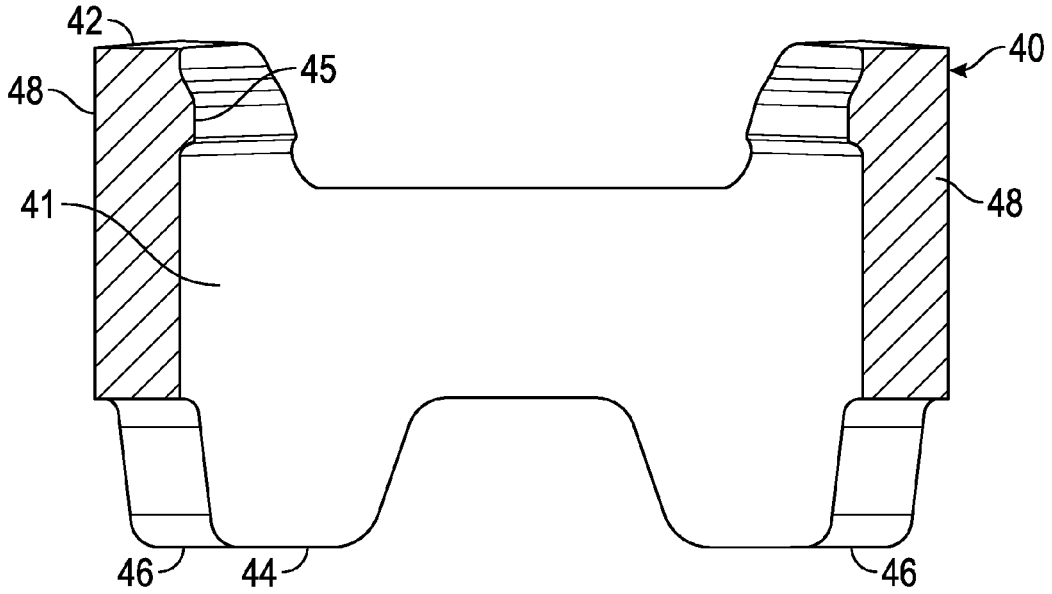
FIG. 6 is a cross-sectional view of the shim shown in FIG. 5 along lines 6-6.

A preferred shim 40 of the present invention is shown in FIGS. 5 and 6. The shim 40 is a cylindrical adjustment piece with an upper surface 42 that is not parallel with its lower surface 44, such that it has an angle a and tilts the shaft sleeve 100 when the shim 40 is sandwiched between the upper portion 110 of the shaft sleeve or another shim 30 and the hosel 20. The shim 40 comprises a first plurality of teeth 46 that are sized to mate with matching alignment features on the hosel 20, and a second plurality of teeth 48 sized to mate with matching alignment features on another shim 30. In an alternative embodiment, the second plurality of teeth 48 may mate with the teeth 112 of the shaft sleeve, or may be identical in size and shape to the first plurality of teeth 46. The shim preferably includes an alignment divot 43 that mates with an alignment protrusion (not shown) extending from a lower surface of the other shim 30. The shim 40 also comprises an internal surface 41 from which a ridge 45 extends. As shown in FIGS. 5 and 6, the ridge 45 preferably is disposed only on the internal surface 41 of the second plurality of teeth 48, such that it is discontinuous, but in other embodiments may be disposed anywhere on the internal surface 41 and may extend continuously around the entire inner circumference of the shim 40. The shim has an internal diameter $D_6$ that is greater than both $D_2$ and $D_3$, except for the ridge 45, which has a diameter $D_7$ that is smaller than $D_3$.

Figure 7:
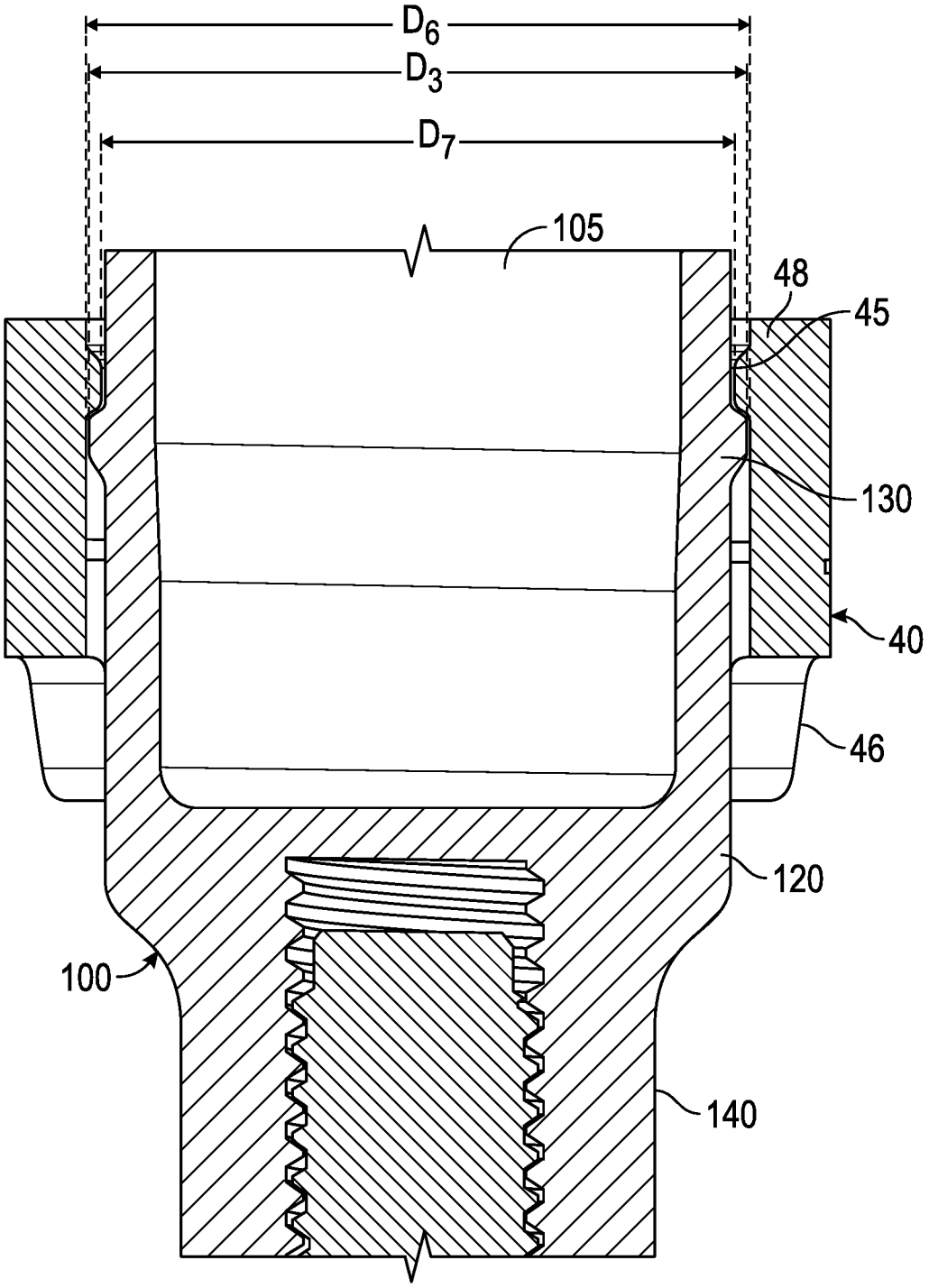
FIG. 7 is a view of the cross-sectional shaft sleeve shown in FIG. 4 engaged with the cross-sectional shim shown in FIG. 6.

As shown in FIG. 7, the shim 40 is attached to the shaft sleeve 100 by sliding the shim 40 over the tip portion 140 and middle portion 120 of the shaft sleeve 100 until the shim 40 ridge 45 makes contact with the ridge 130 on the shaft sleeve 100. Sufficient pressure will cause the shim 40 to deform slightly so that the shim 40 ridge 45 is pushed up and over the ridge 130 on the shaft sleeve 100, preferably making a snapping or clicking sound as it does so to indicate that it has successfully been installed on the shaft sleeve 100. Once the ridge 45 on the shim 40 is disposed on the upper side the shaft sleeve 100 ridge 130, the shim 40 cannot be removed from the shaft sleeve 100 without exerting enough pressure to deform it again. If no pressure is placed on the shim 40, it will not disengage from the shaft sleeve 100—instead, when the shaft sleeve 100 is removed from a hosel 20, the shim 40 ridge 45 will rest against the ridge 130 on the shaft sleeve 100, thus retaining the shim 40 on the shaft sleeve 100. The shim 40 also preferably can move freely on the shaft sleeve 100 between the ridge 130 and the upper portion 110 of the shaft sleeve 100 unless the other shim 30 is also disposed on the shaft sleeve 100, in which case the shim 40 can move between the ridge 130 and the other shim 30.

Figure 8:
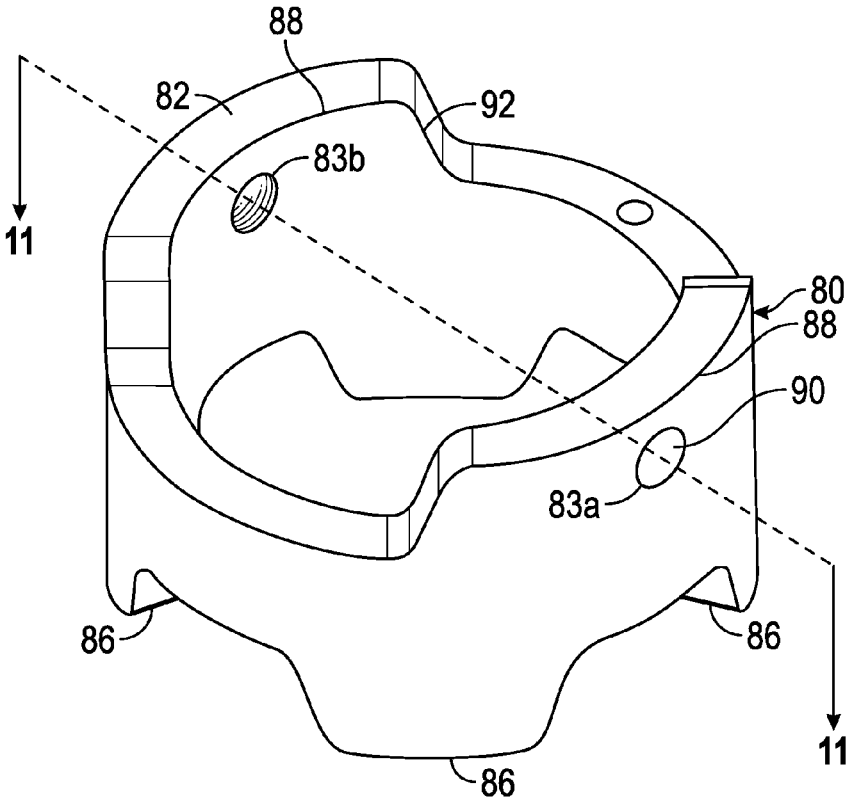
FIG. 8 is a top perspective view of an alternative embodiment of the lower shim shown in FIG. 5.
Figure 9:
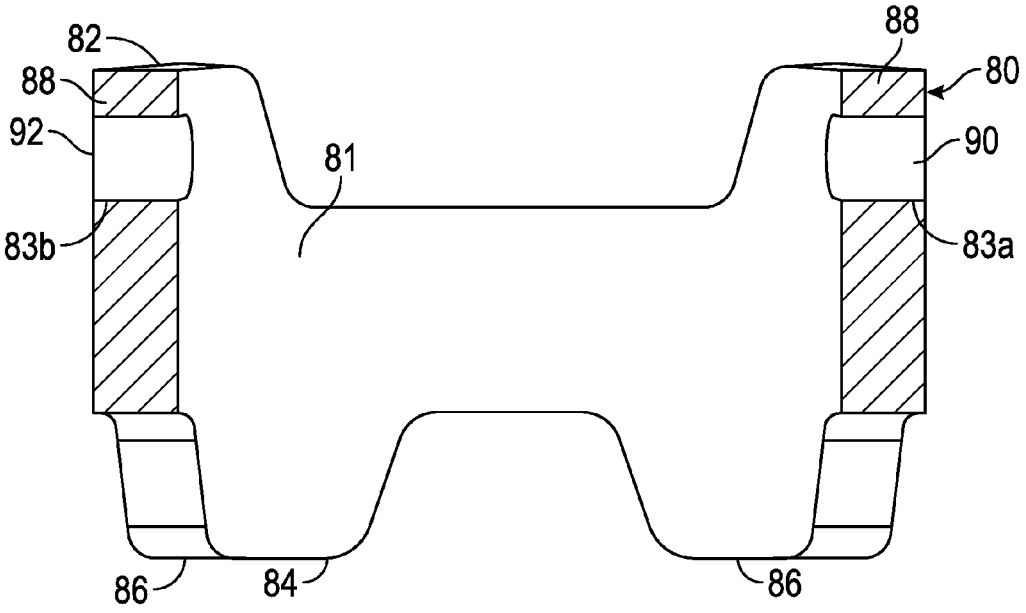
FIG. 9 is a cross-sectional view of the shim shown in FIG. 8 along lines 9-9.
Figure 10:
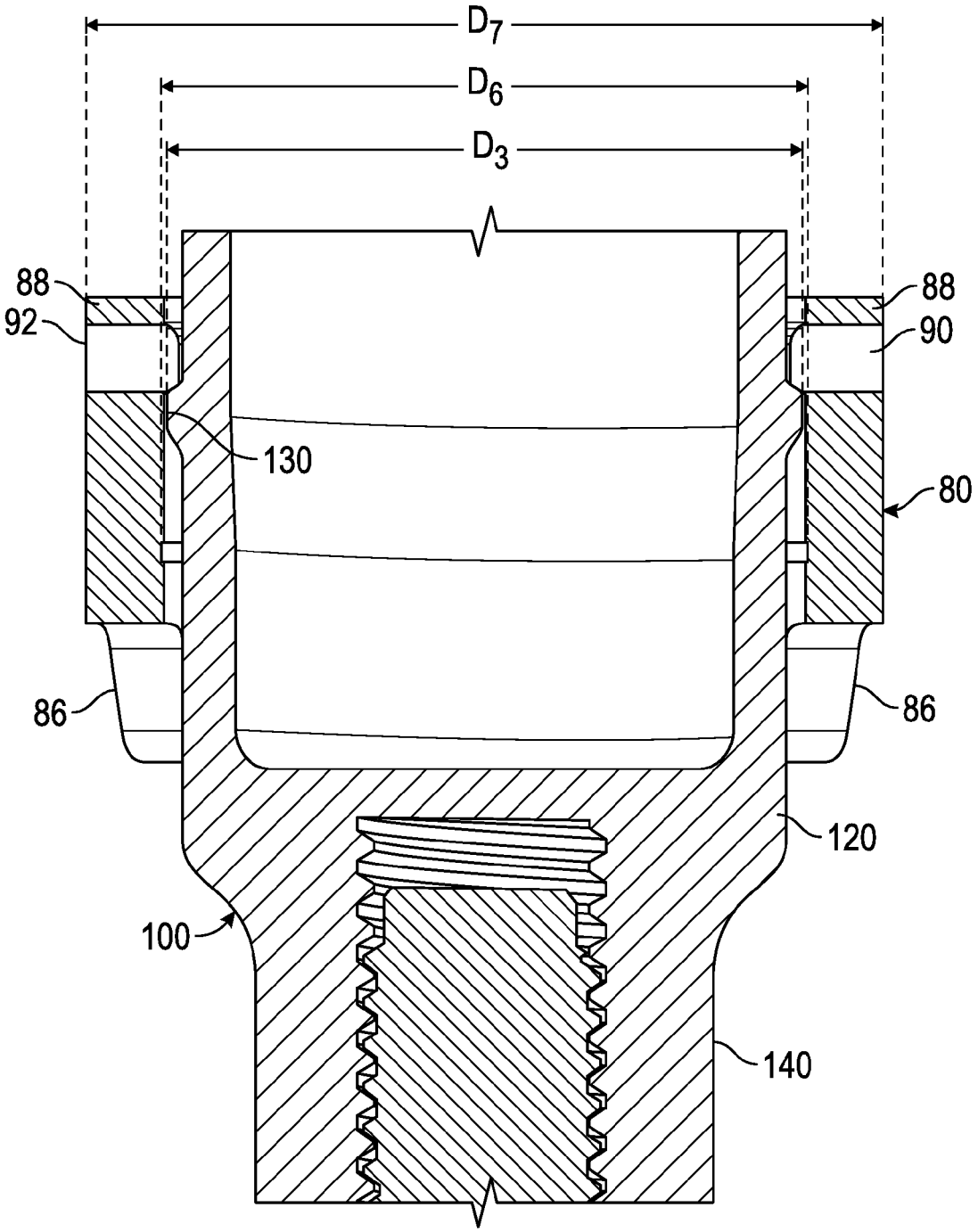
FIG. 10 is view of the cross-sectional shaft sleeve shown in FIG. 6 engaged with the cross-sectional shim shown in FIG. 11.

A second embodiment of the shim 40 disclosed herein is shown in FIGS. 8-10. In this embodiment, the shim 80 has all of the same features as the shim 40 disclosed in connection with the preferred embodiment, including first and second pluralities of teeth 86, 88, non-parallel upper and lower surfaces 82, 84, and a cylindrical internal surface 81. This shim 80 does not include a ridge, however. Instead, it comprises a pair of through bores 83*a*, 83*b* extending through each of the second plurality of teeth 88, and a pair of alignment pins 90, 92 securely fitted within the through bores 83*a*, 83*b*. The alignment pins 90, 92 extend into the hollow interior of the shim 80 and to create a functional internal diameter of $D_7$. The shim 80 can be attached to the shaft sleeve 100 in the same manner as the shim 40 disclosed above, except that the alignment pins 90, 92 preferably are made from a softer material than the shim 80 and bend more easily to increase the ease of attaching and removing the shim 80 from the shaft sleeve 100. In any event, as shown in FIG. 10, the alignment pins 90, 92 abut the ridge 130 on the shaft sleeve 100 when the shim 80 is fully installed on the shaft sleeve 100 and prevent the shim 80 from falling off.

The second shim 30 may or may not include a ridge, but otherwise includes each of the features described in connection with the first shim 40, including a first plurality of teeth 36 that interact with the teeth 112 disposed on the shaft sleeve 100 and a second plurality of teeth 38 that interact with the second plurality of teeth 48 on the first shim 40. The shims 30, 40 and shaft sleeve 100 disclosed herein preferably are composed of one or more lightweight but structurally sound materials, including but not limited to plastic, composite, aluminum, titanium alloy, and/or other such materials. In each of the embodiments disclosed herein, the ridge 130 preferably is integrally formed with the shaft sleeve 100 and the ridge 45 is integrally formed with the shim 40, though in alternative embodiments these ridges 130, 45 may be formed separately and permanently or temporarily affixed to the shaft sleeve 100 and shim 40.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An adjustable golf club comprising:

a golf club head comprising a hosel;

a shaft sleeve comprising a bell-shaped tip end, a middle portion, an upper end, a shaft-receiving bore disposed in the upper end and extending into the middle portion, an external surface, and a first ridge protruding from the external surface;

a first tubular adjustment piece comprising non-parallel upper and lower surfaces, an interior surface, and a second ridge protruding from the interior surface, the tubular adjustment piece encircling at least a part of the middle portion of the shaft sleeve; and a fastener comprising a threaded extension, wherein the tip end comprises a threaded tip bore, wherein the threaded extension engages with the threaded tip bore, and wherein the first ridge abuts the second ridge to removably fix the tubular adjustment piece on the shaft sleeve between the second ridge and the upper end.

2. The adjustable golf club of claim 1, wherein the first ridge is integrally formed with the shaft sleeve.

3. The adjustable golf club of claim 1, wherein the second ridge is integrally formed with the first tubular adjustment piece.

4. The adjustable golf club of claim 1, wherein each of the shaft sleeve and the first tubular adjustment piece is composed of an aluminum alloy.

5. The adjustable golf club of claim 1, wherein the first ridge extends around the entire circumference of the shaft sleeve.

6. The adjustable golf club of claim 1, wherein the second ridge does not extend around the entire internal circumference of the first tubular adjustment piece.

7. The adjustable golf club of claim 1, further comprising a second tubular adjustment piece, wherein the second tubular adjustment piece encircles at least a part of the middle portion of the shaft sleeve, and wherein the second tubular adjustment piece is disposed between the first tubular adjustment piece and the upper end of the shaft sleeve.

8. The adjustable golf club of claim 7, wherein the second tubular adjustment piece comprises a third ridge protruding from an interior surface.

9. The adjustable golf club of claim 1, wherein the upper end has a first diameter, wherein the middle portion has a second diameter, wherein the tip end has a third diameter, and wherein the first diameter is greater than the second diameter and the third diameter.

10. The adjustable golf club of claim 9, wherein the first tubular adjustment piece is movable between the first ridge and the upper end when the shaft sleeve is not engaged with the hosel.

11. The adjustable golf club of claim 1, wherein the first tubular adjustment piece comprises a plurality of teeth, and wherein the second ridge is disposed on at least one of the plurality of teeth.

12. The adjustable golf club of claim 1, wherein the shaft-receiving bore comprises a bore axis that is coaxial with an overall axis of the shaft sleeve.

13. The adjustable golf club of claim 1, wherein the hosel comprises a hosel bore sized to receive at least a part of the shaft sleeve.

* * * * *